US005095870A

United States Patent [19]

Place et al.

[11] Patent Number: 5,095,870

[45] Date of Patent: Mar. 17, 1992

[54] ROTARY VALVE FOUR-CYCLE ENGINE

[76] Inventors: George C. Place, Rte. 1; Clifford G. Rahrig, 602 N. Moening, both of Delphos, Ohio 45833

[21] Appl. No.: 716,406

[22] Filed: Jun. 17, 1991

[51] Int. Cl.[5] ..... F01L 7/02

[52] U.S. Cl. ..... 123/190.4; 123/80 BA; 123/190.6; 123/190.8

[58] Field of Search ..... 123/190 R, 190 A, 190 B, 123/190 BB, 190 E, 190 BD, 80 R, 80 BA

[56] References Cited

U.S. PATENT DOCUMENTS

| | | | |
|---|---|---|---|
| 1,414,692 | 5/1922 | Dickerson | 123/190 BA |
| 1,746,728 | 2/1930 | Ensign | 123/80 BA |
| 1,801,367 | 4/1931 | Peterson | 123/80 BA |
| 1,808,671 | 6/1931 | Luyckx | 123/80 R |
| 1,971,060 | 8/1934 | Wills | 123/190 |
| 2,116,022 | 5/1938 | Gross | 123/190 BB |
| 2,975,774 | 3/1961 | Coffey et al. | 123/80 |
| 3,405,701 | 10/1968 | Mealin et al. | 123/190 B |
| 3,893,483 | 7/1975 | Ackerman | 123/190 A |
| 3,945,364 | 3/1976 | Cook | 123/190 BD |
| 4,036,184 | 7/1977 | Guenther | 123/190 E |
| 4,098,514 | 7/1978 | Guenther | 123/190 E |
| 4,134,381 | 1/1979 | Little | 123/190 E |
| 4,517,938 | 5/1985 | Krüger | 123/190 BB |
| 4,545,337 | 10/1985 | Lyons et al. | 123/190 A |
| 4,751,900 | 6/1988 | Ruffolo | 123/190 BB |
| 5,003,942 | 4/1991 | Hansard | 123/190 BB |

*Primary Examiner*—E. Rollins Cross
*Assistant Examiner*—Erick Solis
*Attorney, Agent, or Firm*—C. Hercus Just

[57] ABSTRACT

An internal combustion engine which includes a combustion head adapted to be bolted to the top of a cylinder block and includes a solid cylindrical rotary valve extending longitudinally in a complementary bore in the head which is parallel to the axis of the crankshaft of the engine. The valve has a pair of cutout passages respectively in different rotary angular positions relative to each cylinder in the engine and respectively comprising intake and exhaust passages that communicate respectively with gas inlet ports and exhaust outlet ports in the combustion head, thereby providing a simple substitute for poppet-type valves and the operating mechanism therefor in internal combustion gasoline engines.

2 Claims, 4 Drawing Sheets

FIG. 7
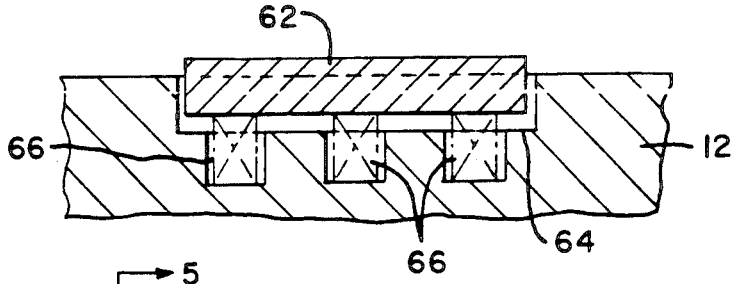
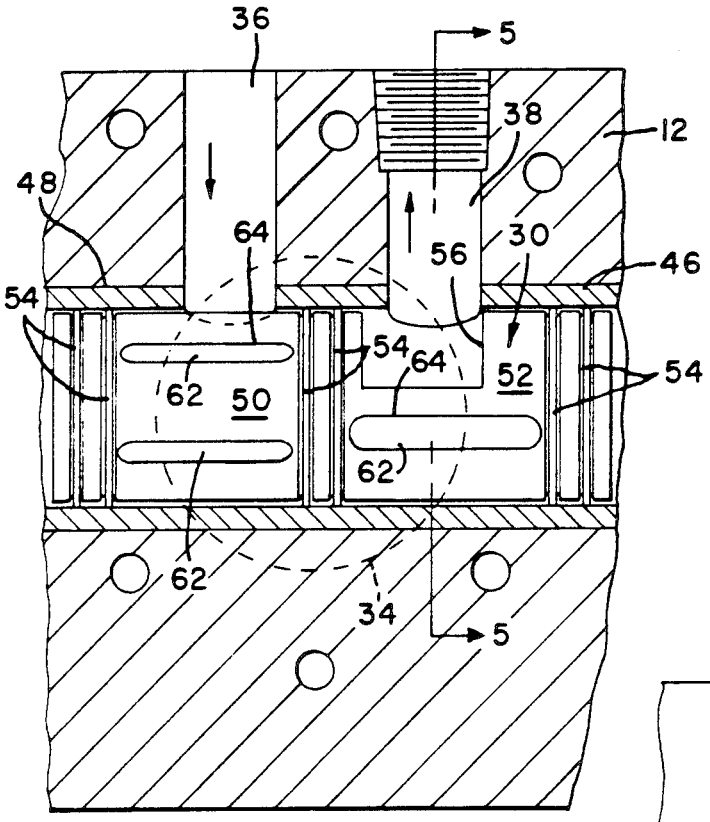
FIG. 8
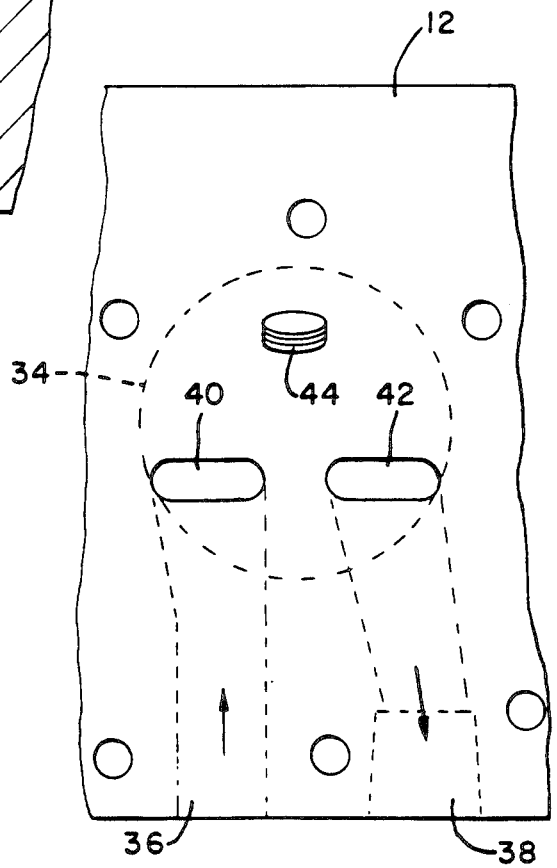
FIG. 9

ROTARY VALVE FOUR-CYCLE ENGINE

This invention pertains to a four-cycle type internal combustion engine of the type utilizing rotary valves to control the intake and exhaust of the power cylinders.

BACKGROUND OF THE INVENTION

The vast majority of internal combustion engines in use at present utilize poppet-type valves. At least in theory, rotary valve-type engines have certain advantages over poppet valve engines, but for some reason or other, rotary valve engines are not in any substantial popular use.

Engines having poppet-type valves are far more complex than those having rotary valves because of the need to associate with the pistons and compression chambers, such additional features as a cam shaft, valve lifters and guides, rocker arms and valve springs; while in contrast, a rotary valve engine requires only a rotatable valve and appropriate seals. The latter elements characteristically have relatively long life and, in general such engines provide increased efficiency in fuel consumption and in addition, usually operate more smoothly and are more quiet in operation than poppet valve-type engines.

Despite the foregoing advantages of rotary valve engines over poppet-type valve engines, it appears that the purchasing public has not adopted the rotary valve-type engines to any appreciable extent. Perhaps this is because manufacturers and repair garages have heavy investment in equipment to manufacture and repair engines having poppet-type valves. Coupled with this is the additional fact that certain problems are characteristic of rotary valve engines, such as adequate sealing, lubrication, tooling and difficulty in repair and maintenance.

Among patents in the prior art, there especially are two which pertain to rotary valve engines that are of interest to the present invention but over which the invention is believed to be patentably distinguishable. These patents are:

U.S. Pat. No. 1,414,692 - Dickerson May 2, 1922

U.S. Pat. No. 3,945,364 - Cook Mar. 23, 1976

These patents are directed to two-cylce engines, whereas the invention embodies a four-cycle principle for smooth and quiet operation.

There also are additional patents of less interest:

U.S. Pat. No. 1,746,728 - Ensign Feb. 11, 1930

U.S. Pat. No. 1,801,367 - Peterson Apr. 21, 1931

U.S. Pat. No. 1,808,671 - Luyckx June 2, 1931

U.S. Pat. No. 1,971,060 - Wills Aug. 21, 1934

U.S. Pat. No. 2,975,774 - Coffey et al Mar. 21, 1961

U.S. Pat. No. 4,134,381 - Little Jan. 16, 1979

SUMMARY OF THE INVENTION

It is among the basic principles of the present invention to provide an internal combustion engine with a very simple rotary valve having a minimum of elements and especially a solid cylindrical valve having a pair of chord-like passages cut in the periphery thereof respectively for providing fuel inlet and exhaust discharge for each cylinder and the head, which is bolted to the cylinder block, has a pair of passages therein for each cylinder of the engine, said passages respectively communicating with fuel and exhaust manifolds.

Another object of the invention is to cast the cylinder head from aluminum and the same has a longitudinal bore in which a sleeve of cast iron is fixed to receive said valve rotatably. Said sleeve has a relatively thin wall and ports therein communicate respectively with intake and exhaust ports in said head.

Still another object of the invention is to provide said rotatable valve with circular grooves and sealing rings therein at locations between each pair of intake and exhaust ports and thereby seal the areas of said valve respectively adjacent said ports.

One other object of the invention is to provide the cylindrical surface areas of the valve, which are between the edges of said chord-like passages, with axially-extending seats spaced circumferentially in said valve between pairs of said sealing rings associated with each of said ports, an elongated sealing member of compressed carbon being positioned in each of said seats and elastic members in said seats are operable to urge said sealing members against the inner surface of the sleeve in which said valve rotates and thereby urge said chord-like passages of said valve firmly against the interior surface of said sleeve to minimize unintended escape of exploding fuel and exhaust gases.

Details of the foregoing objects of the invention and other objects thereof are set forth in the following specification and illustrated in the accompanying drawings comprising a part thereof.

DETAILED DESCRIPTION OF THE DRAWINGS

FIG. 7 is a fragmentary axial sectional view of a portion of the rotary valve illustrating the spring-biasing arrangement for the seals on the valve.

FIG. 8 is a horizontal sectional view of one portion of the valve showing a pair respectively of inlet and exhaust ports and illustrating one chord-like passage and the axially-disposed seals in the rotary valve.

FIG. 9 is a sectional plan view of the lower face of the head area for each piston and showing a pair of inlet and outlet passages and a spark plug-receiving port.

DETAILED DESCRIPTION OF THE PREFERRED EMBODIMENTS OF THE INVENTION

The principal purpose of the present invention is to provide an extremely simple rotary valve internal combustion engine which is rugged and durable and is the result of several years of experimental operation of a single cylinder engine. The results have been sufficient to convince the applicant that the basic principles thus tested can be adapted to a multiple cylinder engine utilizing those basic principles which now are incorporated in the following detailed disclosure as illustrated in the accompanying drawings.

Figure 1:
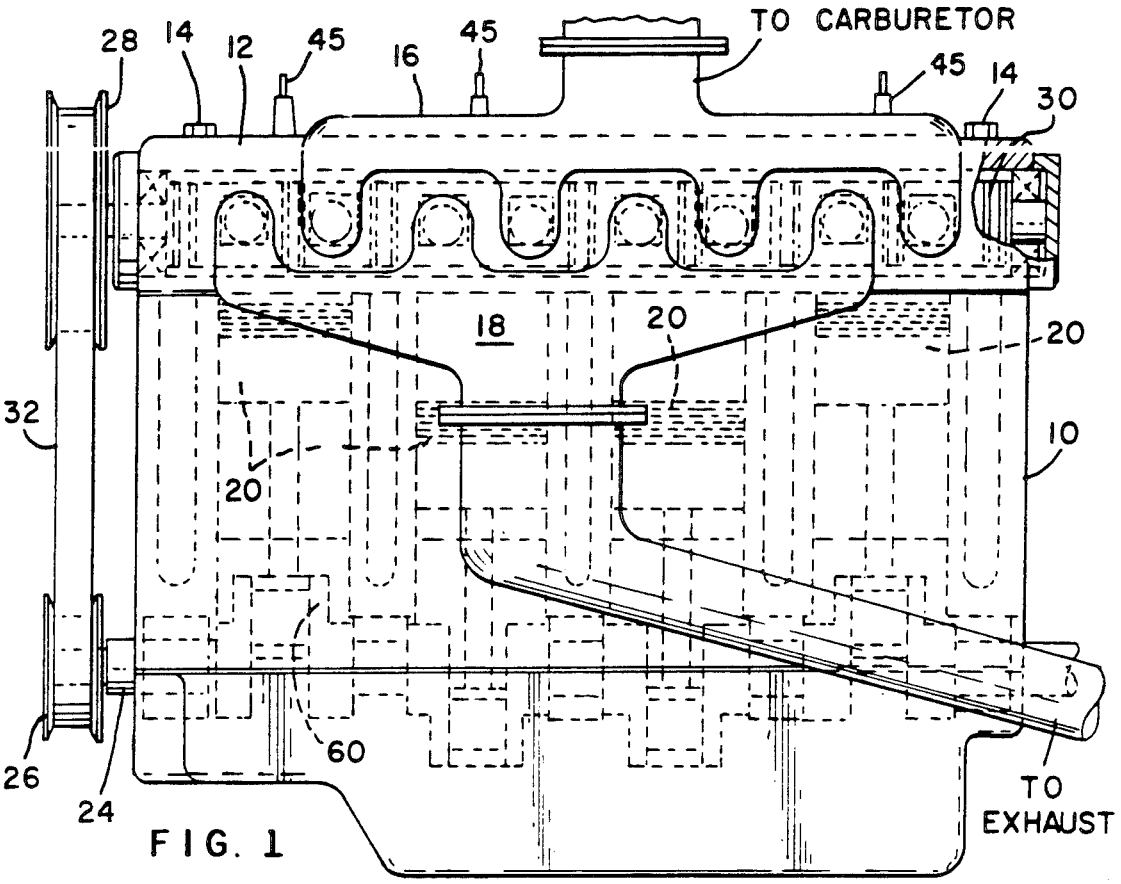
FIG. 1 is a side elevation of an exemplary multi-cylinder internal combustion engine of the four-cycle type, which embodies the present invention.

Referring to the various figures, an exemplary disclosure of an internal combustion engine of the type to which the present invention is applicable, is illustrated in FIG. 1, in side view, such exemplary disclosure shows a cylinder block 10 mounted on the upper end of head 12, which is secured to the block by appropriate bolts 14. There also is a conventional-type of gas manifold 16 which is connected to a carburetor, not shown, and the exhaust from the pistons discharges to the exhaust manifold 18, which extends to an exhaust pipe or conduit and muffler, neither of which are shown.

Figure 2:
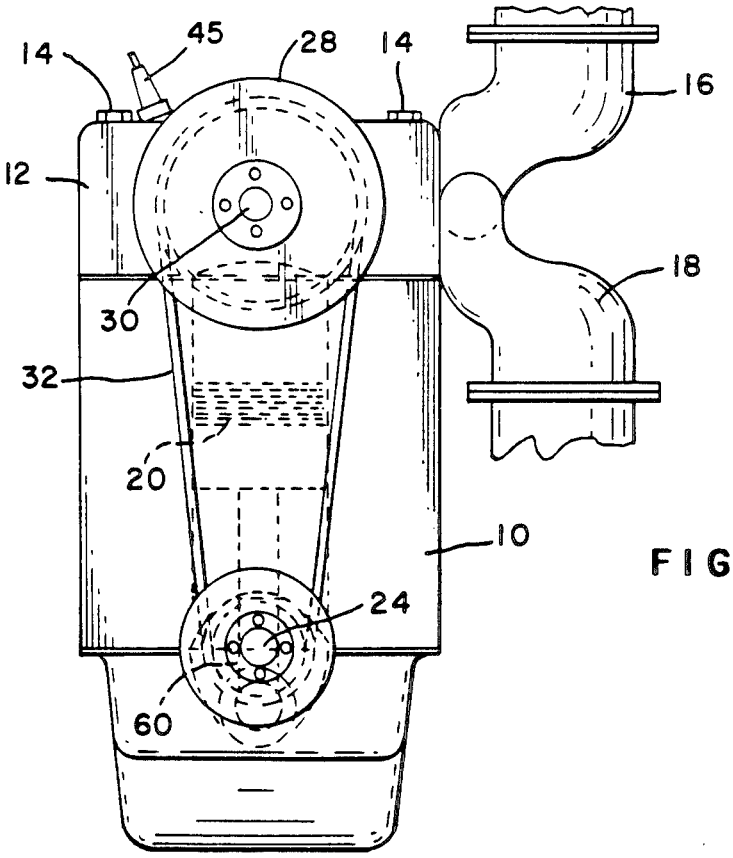
FIG. 2 is a vertical elevation view of the engine shown in FIG. 1, as seen from the forward end and showing the timing belt in operative position.

Referring to FIG. 2, a front end view of the engine shown in FIG. 1 is illustrated and shows, in phantom, a conventional piston 20 which is connected by a connecting rod 22 to a crankshaft 24. A driving pulley or gear 26 is connected to a projecting forward end of the crankshaft 24 and another gear 28 is connected to the forward end of a rotary valve 30. Preferably, a timing belt 32 extends around driving gear 26 and valve gear 28, said gears being of the type with which a timing belt operates to maintain the gears in synchronism with each other, as is essential for the operation of the device.

The most essential element of the present invention is the rotary valve 30. Referring particularly to FIG. 8, a section of the valve 30 is shown in a fragmentarily illustrated portion of head 12. The rotary valve 30 preferably comprises a solid cylinder from end to end. As can be visualized from FIG. 1, the unitary valve extends within the head for an exemplary series of four cylinders which are not shown in detail in FIG. 1, but it can be visualized from the view that the engine shown therein can comprise a plurality of cylinders and, in particular, four cylinders. As shown in FIG. 8, the section of the rotary valve 30 illustrated therein serves a single cylinder 34, shown in phantom, and each cylinder is served by an intake port 36 and an exhaust port 38, the latter being shown as having a threaded entrance for connection to an exhaust manifold, for example.

Referring to FIG. 9, which is a plan view of the lower flat surface of head 12 and in which the outline of cylinder 34 also is shown in phantom, it will be seen that the portion of the head which serves each cylinder is provided with an intake port 40 and an exhaust port 42, as well as a threaded port 44, in which a spark plug 45, see FIGS. 1 and 2, is fitted. Communication between the intake port 36 which enters from one side of the head 12 and the intake port 40, which is formed in the inner face of said head, is illustrated by phantom lines. Likewise, communication between exhaust port 42 on the inner face of head 12 and exhaust port 38 that extends through one side of the head 12 also is illustrated by phantom lines.

Returning to the sectional view, shown in FIG. 8, it will be seen that each cylinder 34 is served by an intake port 36 and an exhaust port 38 which project through suitable openings in a preferably cast iron sleeve 46, which is press-fitted or otherwise inserted into a cylindrical bore 48 in the head 12. As shown in FIG. 8, it will be seen that the section of the rotary valve 30 which serves the single cylinder illustrated therein actually comprises a pair of sections 50 and 52, which respectively are defined by pairs of slightly-spaced sealing rings 54, respectively fitted within complementary grooves formed in valve 30. The solid valve 30, in practice, serves one or more cylinders.

Figure 3:
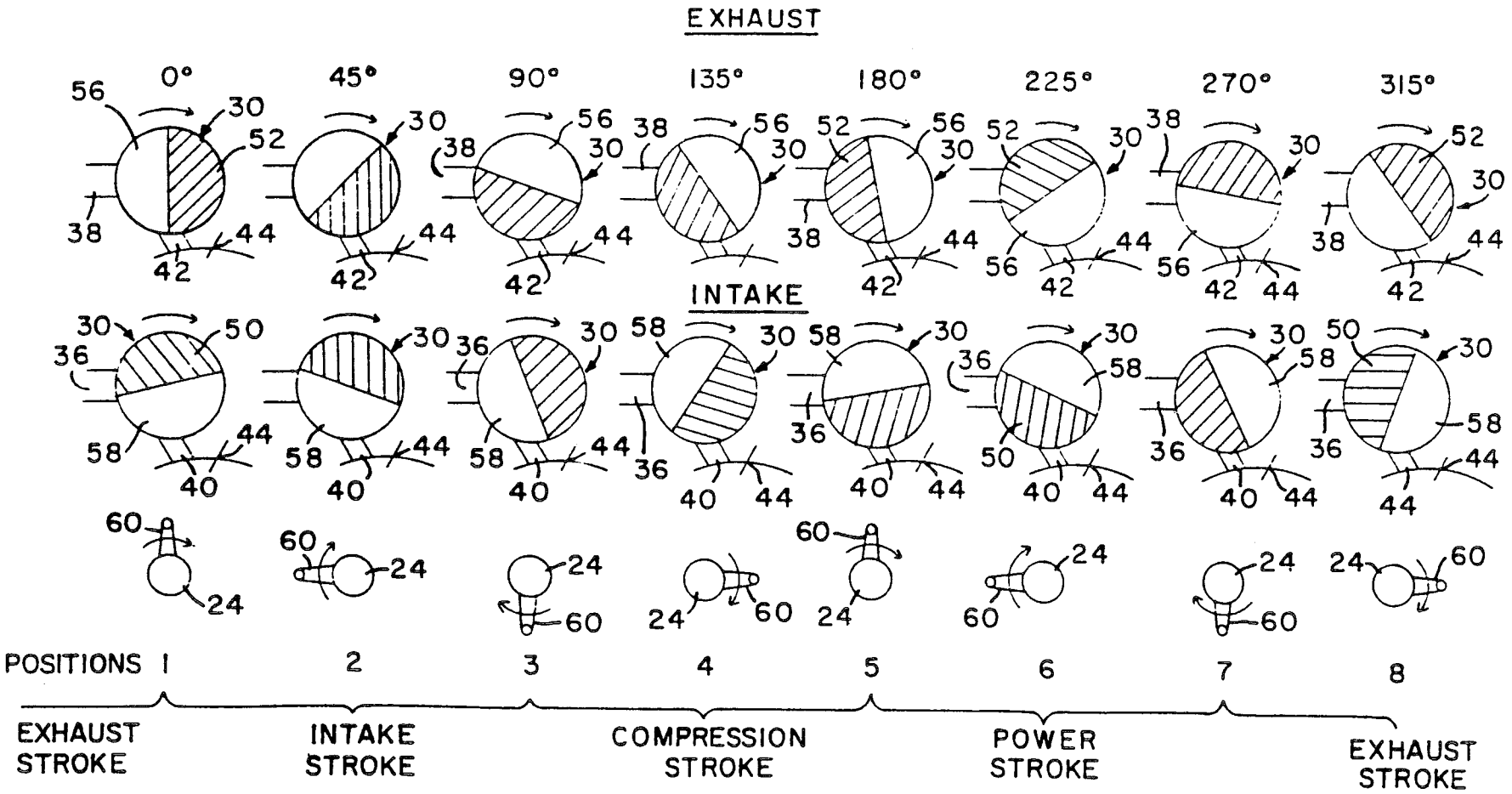
FIG. 3 is a diagrammatic illustration showing sectional views of the sequential positions of one pair of chord-like passages in the rotary valve, one row of such passages showing the passages for exhaust gases and a second row showing the corresponding passages for intake fuel to the cylinder.

One of the very important features of the present invention comprises the fact that valve 30 is formed from a solid cylindrical element into which the grooves for the sealing rings 54 are formed, said rotary valve being integral from end to end and formed with a pair of transverse chord-like passages 56, one of which is shown in FIG. 8 in the section 52 of the valve. Referring to FIG. 3, there is shown therein, in the upper row of diagrammatic sections of the valve 30, various exemplary positions of the somewhat enlarged sizes of chord-like exhaust openings 56 in the valve during rotation thereof, as illustrated in 45° of rotary movement of the valve. Similarly, the corresponding positions of the somewhat enlarged chord-like intake openings 58 during the intake cycle are shown in the respective corresponding positions thereof during such rotary movement of the valve in relation to the intake ports 36 from the manifold, as well as the intake ports 40 in the lower face of the head 12. In the upper and lower rows of the illustrations in FIG. 3, the respective exhaust ports 38 and 42 and intake ports 36 and 40 are served by all of the positions of the chord-like openings of rotary valve 30.

Figure 4:
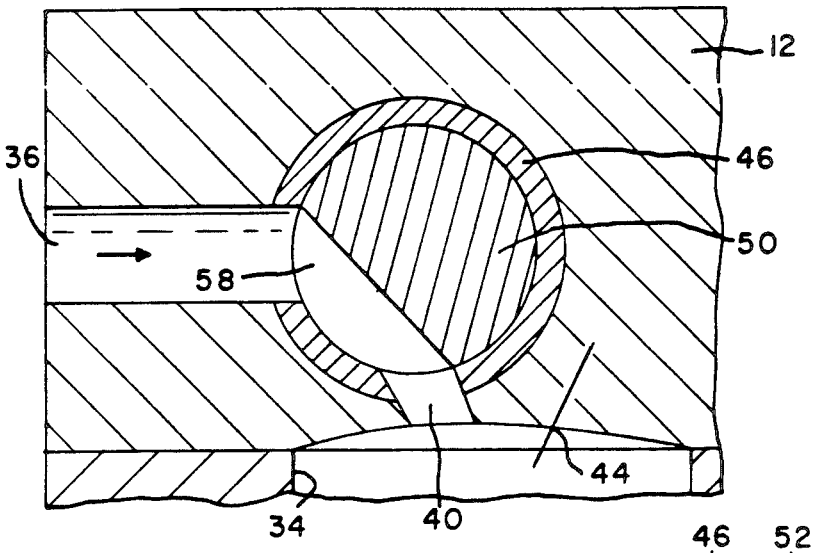
FIG. 4 is a sectional enlarged view of the rotary valve with the chord-like passage facing the fuel inlet port.
Figure 5:
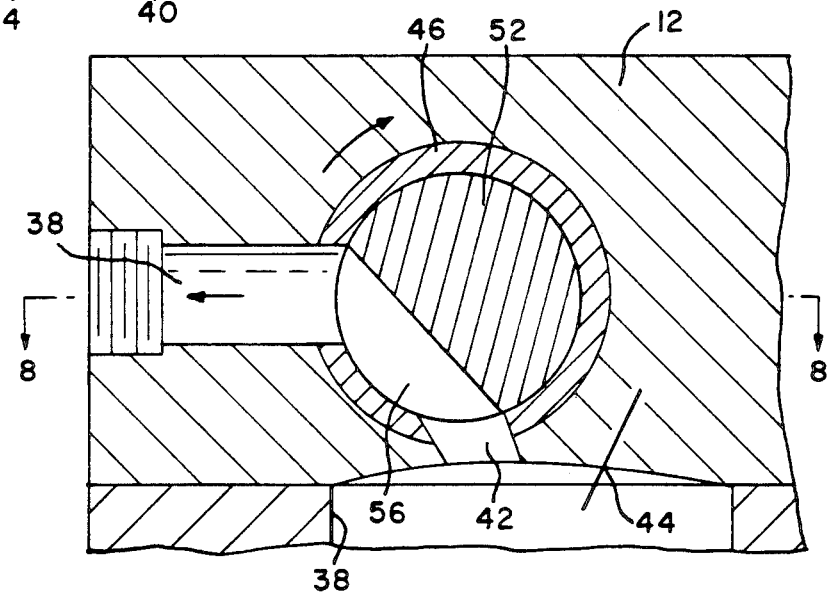
FIG. 5 is a similar sectional enlarged view of the rotary valve with the chord-like passage in position to receive exhaust discharge from the cylinder.

It will be understood that the positions of the exhaust chord-like passages 56 in the upper row of valve sections illustrated in FIG. 3, as well as the positions of the intake chord-like passages 58 in the lower row of valve sections shown in FIG. 3, and somewhat exaggerated in size, are approximate, but are relatively accurate in positions. The relative sizes of chord-like passages 56 and 58 as shown respectively in FIGS. 5 and 4, are closer in practice to actual size relative to the diameter of rotary valve 30. With respect to the bottom row of figures, shown in FIG. 3, this illustrates the positions of the crankshaft 34 and the connecting rod arms 60 of the crankshaft, as shown in phantom in FIG. 2 relative to the corresponding positions of the chord-like exhaust and intake passages 56 and 58. The illustrations of the positions of each crank arm 60 of the crankshaft 24 as well as the relative positions of the chord-like passages 56 and 58, are illustrated in relation to a portion of the exhaust stroke, the intake stroke, the compression stroke, the power stroke, and the other half of the exhaust stroke, thus comprising two rotations of the valve 30, which occur with respect to a single rotation of the crankshaft 24. Thus, the invention pertains to a four-cycle engine and this principle has been selected in view of the greater power that is conventional with respect to a four-cycle engine as contrasted with a two-cycle engine, especially for purposes of smoother operation than afforded by a two-cycle engine.

Referring to FIGS. 4 and 5, these views have been included to show in a much larger scale than in FIG. 3, the relative positions of the fuel intake arrangement in FIG. 4 and, in comparison, the exhaust gas arrangement with the relative ports in the head of the engine during the exhaust cycle, are shown in FIG. 5.

Figure 6:
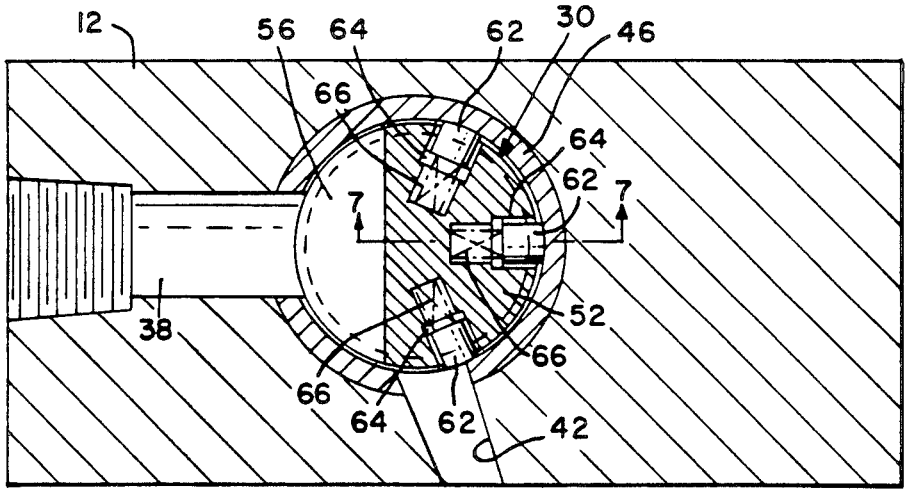
FIG. 6 is a sectional view of rotary valve taken through the seal arrangement for each section of the valve between circular seals which define areas of the head having a pair of inlet and exhaust ports for each cylinder.

Another important feature of the present invention comprises the additional seal arrangement illustrated in FIGS. 6 and 7 with respect to the periphery of the rotary cylinder 30 with respect to both sections 50 and 52 as related to each cylinder of the engine. Attention is also directed to FIG. 8 in which the elongated seals 62, which are formed of compressed carbon, respectively are disposed in complementary elongated groove-like seats 64, and said seals are urged radially outward preferably by a plurality of compression springs 66. It will be understood that a very limited amount of clearance is provided between the periphery of rotary valve 30 and the inner surface of sleeve 46 within which the preferably cast iron valve 30 is rotatable mounted. It readily can be visualized that because of the action of the springs 66 against the seal members 62 which, due to the disposition of the plurality of said seal members, urge the section of the rotary valve 30 in which the chord-like passages 56 and 58 are disposed, advantageously against the inner surface of sleeve 46 and thus, maximize the successive connection of the chord-like passages with the inner surface of sleeve 46, as when said passages coincide with not only the intake port 40 in the head, but also the exhaust port 38 in the head, thereby maximizing the power to be delivered by the engine. Preferably, the springs 66 are disposed within complementary radial sockets, clearly shown in FIG. 7.

From the foregoing, it will be seen that the present invention provides a rotary valve type internal combustion engine which is extremely simple in construction and utilizes a minimum of elements to constitute an effective and efficient four-cycle type internal combustion engine, adaptable for use either with a single cylinder or multiple cylinders in an engine. Effective sealing is afforded with respect to each of the sections of the cylindrical valve which effects firing and discharge of the pistons in a smooth and satisfactory manner to provide maximum power with respect to the consumption of fuel by the engine.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A four-cycle internal combustion engine having at least one cylinder and a piston reciprocated therein by a piston rod and crankshaft operating in an engine block, in combination with an aluminum combustion head tightly connected to the top of said block, said head having a fuel inlet port and an exhaust port therein respectively for each cylinder and said head also having internal passages therein respectively between said fuel inlet port in said head and said fuel discharge port in said head and also between said exhaust port in said head and said exhaust inlet port in said head, a cylindrical bore therein parallel to the axis of said crankshaft, a cast iron cylindrical sleeve of limited thickness press-fitted within said cylindrical bore and a solid elongated cylindrical valve rotatable within said sleeve and complementary therewith in size, said valve having formed in the periphery thereof respectively for each cylinder a pair of transverse chord-like passages placed at an angle to each other and respectively comprising a pair of fuel-inlet and exhaust discharge passages communicating respectively in sequence between said cylinders and said fuel-inlet and exhaust ports in said head, and a spark plug port in said head for each cylinder in which a spark plug is mounted in each said port.

2. The internal combustion engine according to claim 1 in which said valve is formed of cast iron.

* * * * *